United States Patent [19]

Lomagno

[11] 3,967,802

[45] July 6, 1976

[54] SAFETY STAND FOR IRONS

[76] Inventor: Marcel Lomagno, 26-20 E. 13th St., Brooklyn, N.Y. 11218

[22] Filed: Sept. 4, 1974

[21] Appl. No.: 502,919

[52] U.S. Cl. ..... 248/117.4; 38/142; 248/117.6; 248/117.7

[51] Int. Cl.[2] ..... D06F 79/00

[58] Field of Search ..... 248/117.1–117.7, 248/51; 38/96, 107, 142; 211/43

[56] References Cited

UNITED STATES PATENTS

| | | | |
|---|---|---|---|
| 1,598,488 | 8/1926 | Michael | 248/117.3 |
| 1,682,060 | 8/1928 | Banks | 211/43 |
| 1,750,576 | 3/1930 | Cubberley | 211/43 X |
| 1,774,541 | 9/1930 | Andrea | 248/117.1 |
| 2,227,916 | 1/1941 | Steele | 248/117.2 |
| 2,493,455 | 1/1950 | Harris | 248/117.3 |
| 2,514,400 | 7/1950 | Larkins | 248/117.7 |
| 2,904,296 | 9/1959 | Graham | 248/117.7 |
| 3,127,141 | 3/1964 | Elliston | 248/117.6 |
| 3,162,415 | 12/1964 | St. Pierre | 248/117.6 |
| 3,176,947 | 4/1965 | Inverso | 248/117.6 |
| 3,315,928 | 4/1967 | Morozzo et al. | 248/117.1 |

*Primary Examiner*—Roy D. Frazier
*Assistant Examiner*—Rodney H. Bonck

[57] ABSTRACT

A safety stand is described for an iron having heated portions and a handle. The stand includes a substantially enclosed housing for receiving the iron and covering the heated portions thereof. The housing has an opening in the upper region thereof dimensioned to permit insertion into and removal of the iron from the housing. The housing is configurated to conform to the exterior shape of the iron and dimensioned to receive the iron with little clearance to prevent excessive movement of the iron when disposed within the housing. The handle of the iron continues to be exposed at least partially through the housing opening to permit the same to be gripped for removal of the iron from the housing. Mounting means, in the form of two planar members having hook-shaped ends, is provided for securely fixing the housing to an ironing board. Advantageously, locking means is provided for preventing inadvertent movement of the iron from the housing. In this manner, the iron is securely maintained within the housing during periods of non-use, with the heated portions thereof concealed to prevent injury or damage when the ironing board is in its normal upright position or in a knocked-down condition.

17 Claims, 6 Drawing Figures

SAFETY STAND FOR IRONS

BACKGROUND OF THE INVENTION

The present invention generally relates to ironing aids, and more specifically to a safety ironing stand mountable on of ironing board for maintaining the heated portions of the iron covered during periods of non-use in both the normal upright position of the ironing board and in the knocked-down condition thereof.

The use of stands for flatirons is well known. The known iron stands are typically in the form of metallic bases or plates which are intended to support the heated irons during periods of non-use. These iron bases are normally planar and are provided with an upwardly projecting lip or protuberance which conforms to the shaped of the heated portion of the iron which rests on the base. The lip prevents the iron from slipping off the base under normal conditions and, to that extent provides a limited measure of safety.

However, the known iron stands exhibit several disadvantages. Thus, since the above-mentioned bases or plates merely serve as support surfaces for the irons, they do not substantially enclose the irons or cover the heated portions thereof. The known enclosures for irons are normally for storage only and are not adapted for supporting an iron during short periods of non-use. Most known ironing stands are not provided with insulation. For this reason, such stands become heated and may injure a person contacting the same. Most known stands of the type described above are merely placed on the top surface of an ironing board, there being no provision normally made for securing the stand to the ironing board. Herein lies a major disadvantage of prior art stands. Not only do they fail to cover the heated portions of the iron when the iron stand is supported on an upright ironing board, but there is no means provided for maintaining engagement between the iron and the stand when the ironing board is knocked down from its normal upright position. When the ironing board is knocked down, the iron normally becomes dislodged from the stand with the result that all the heated surfaces of the iron become exposed. Such a possibility becomes a major reason for concern when the operator leaves the iron unattended and the ironing board is knocked down by a small child. Under these circumstances, even the limited protection which the stand provides in the upright position of the ironing boards is lost.

A further disadvantage of prior art stands is that they support the irons with heated plates disposed below the handles of the irons. With this arrangement, the heat which rises from the heated plates heats the handles. When the irons are maintained on a stand in this manner for an extended period of time, the handles may become heated to a point where they are uncomforatable to grip.

The present invention is intended to overcome the above and other disadvantages of known ironing stands. More specifically, the stand of the present invention provides a great degree of safety to those promimate to the iron irrespective whether the stand is supported on an upright or knocked - down ironing board. Further, the subject stand maintains the iron in a non-ironing, vertical position which causes minimum heating of the iron handle. These features are achieved with a simple and economical construction which is readily mounted on an ironing board and easy to use.

SUMMARY OF THE INVENTION

Accordingly, it is an object of the present invention to provide a stand for flatirons which does not have the disadvantage of similar stands known in the prior art.

It is another object of the present invention to provide a safety stand for irons as suggested above which is simple in construction and economical to manufacture.

It is still another object of the present invention to provide a safety stand for irons of the type under discussion which can easily be mounted on an ironing board in a secure manner.

It is yet another object of the invention to provide a stand for irons as described in the last object which provides a great degree of safety from contact of the heated portions of the iron when the ironing stand is either in a normally upright position or in a knocked-down condition.

It is a further object to provide a stand for irons of the type under consideration which maintains the irons in a non-ironing, vertical position during periods of nonuse to prevent excessive heating of the iron handles.

It is still a further object of the present invention to provide a stand for irons which includes a substantially closed housing internally provided with insulation to maintain the exterior surfaces of the housing at a low temperature incapable of causing injury on contact.

It is yet a further object to provide an iron stand which includes a substantially closed housing which covers the heated portions of the iron, and which further includes locking means in the form of a latch which retains the iron within the housing and prevents inadvertent movement of the iron out of the housing when the latch is placed in the operative locking condition.

It is additional object, with reference to the last mentioned object, to provide a safety stand of the above type which permits simple insertion and removal of the iron from the housing during ironing when the latch is in the inoperative condition.

In order to achieve the above objects, as well as others which will become apparent hereafter, the safety stand for irons in accordance with the present invention includes a substantially closed housing for receiving an iron and covering the heated portions thereof. Said housing has an opening therein dimensioned to permit insertion into and removal of the iron from said housing. Said housing is configurated to at least partially expose the handle of the iron through said opening when the iron is disposed within said housing to permit gripping of the handle for movement of the iron into and out of said housing. Mounting means is provided for securely fixing said housing to a support surface. In this manner, the iron is freely maintained on a desired support surface and has the heated portions therefore concealed during periods of non-use.

According a presently preferred embodiment, said housing is configurarted to conform to the exterior shape of the iron and dimensioned to receive the iron with little clearance therebetween to prevent the iron from excessive movements when received within said housing. Advantageously, locking means is provided on said housing for engaging the handle of the iron when the latter is disposed within said housing. Said locking means prevents the iron from moving out of said housing during periods o non-use of the iron. Accordingly, the heated portions of the iron are maintained concealed in all positions which said housing may assume. When the housing is mounted on an ironing board, substantially the same degree of protection is provided irrespective of whether the ironing board is in a upright or knocked down condition. of In the embodiment to be described, insulation is provided on the interior surfaces of said housing which are coextensive with the heated portions of the iron. This prevents the exterior surfaces of said housing from becoming overheated when the iron is housed within the same for extended periods of time.

Another advantageous feature of the present invention is the provision of said opening in the region of the top of said housing, in the normal operative position thereof, and the handle of the iron is disposed through a frontal portion of said opening, whereby the heat generated by the heated portions of the iron may escape through the top of said housing without excessively heating the handle of the iron.

A resilient spacer means may be provided within said housing for resiliently abutting against an iron received therein, said spacer means spacing the heated portions of the iron from the walls of said housing and preventing excessive movements of the iron therein.

Said mounting means is preferably of the type which can easily and quickly secure said housing to an ironing board and prevent or minimize movements of said housing, and therefore the iron itself, relative to the ironing board.

BRIEF DESCRIPTION OF THE DRAWINGS

With the above and additional objects and advantages in view, as will hereinafter appear, this invention comprises the devices, combinations and arrangements of parts hereinafter described and illustrated in the accompanying drawings of a presently preferred embodiment in which.

DESCRIPTION OF THE PREFERRED EMBODIMENT

Figure 1:
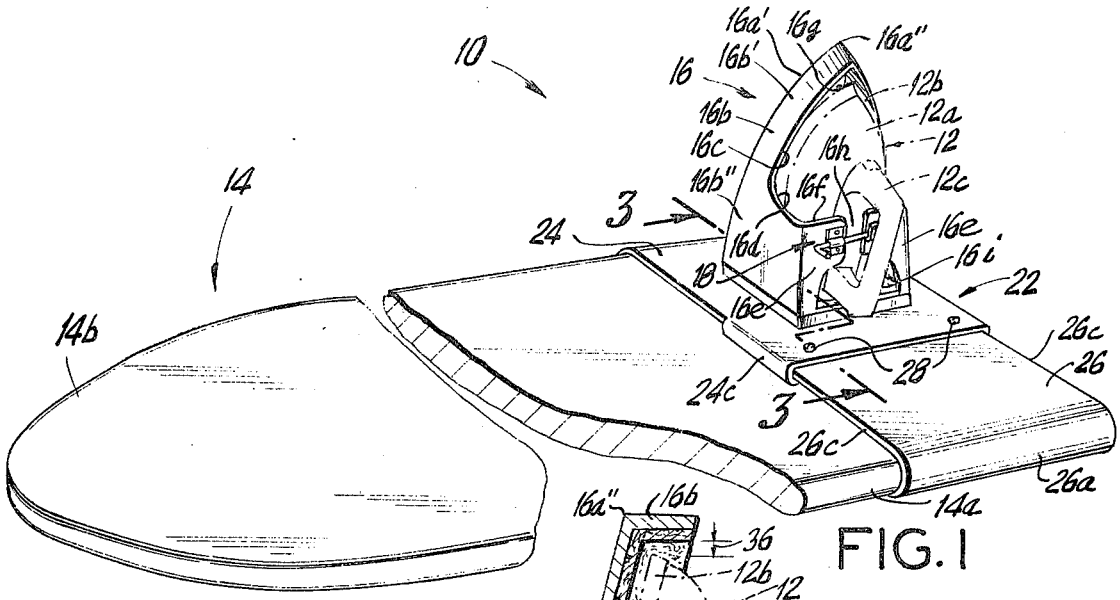
FIG. 1 is a fragmented perspective view of a safety stand for irons in accordance with the present invention, shown mounted on an ironing board.

Referring now to the drawings, in which indentical or similar parts ar designated by the same reference numerals throughout, and first referring to FIG. 1, a safety stand for an iron is generally designated by the reference numeral 10.

The stand 10 is adapted to receive and cover a flatiron 12, as to be described hereafter. The iron 12 is of the type commonly used today in the home and has a body or major portion 12*a*, a heated plate 12*b* and a handle 12*c*. The heated plate 12*b* is in a generally horizontal plane during ironing and in a plane slightly inclined from the vertical when the iron 12 is rested on a supporting surface, as suggested in FIG. 3.

As will become evident, the stand of the present invention may be mounted on any desired support surface such as a table, work bench and the like. The presently preferred embodiment shown in the FIGS. is specifially adapted to be mounted on an ironing board. In FIG. 1, a typical ironing board 14 is shown having a rectangular end 14*a* and a tapered end 14*b*. The stand 10 is shown mounted on the rectangular end 14*a*. In any event, irrespective of the support surface on which it is mounted, the stand 10 is configurated and dimensioned to substantially enclose an iron and cover the heated portions thereof during periods of non-use.

Figure 3:
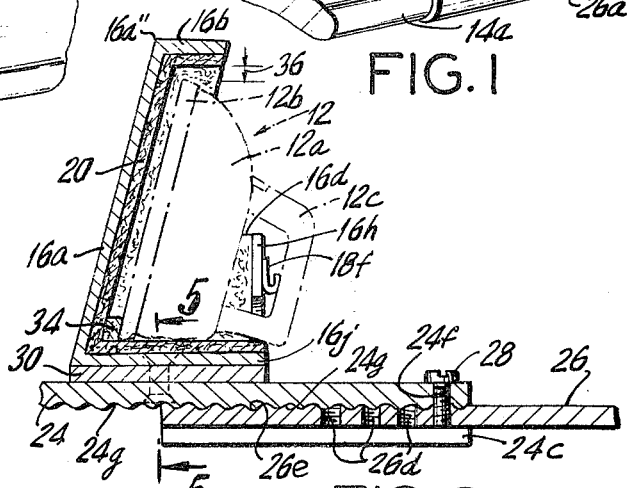
FIG. 3 is an enlarged cross-section of the safety stand shown in FIG. 1, taken along line 3—3.

An important structural element of the present invention is a housing 16 which can generally be described as having a configuration and dimensions corresponding to those of the iron 12 so that the latter may be received within the housing 16 as shown in FIGS. 1 and 3. More specifically, the interior surface of the housing 16 is configurated to conform to the exterior shape of the iron 12 and dimensioned to receive the iron with little clearance therebetween to prevent excessive movements of the iron 12 when received within the housing 16.

The housing 16 has an inclined rear wall 16*a*, best shown in FIG. 3, the rear wall being inclined from the vertical direction to correspond the inclination of the heated plate 12*b* when the iron 12 is disposed in its rest or non-use position. Flatirons generally have tapered front end portions and the rear wall 16*a* has tapered edges 16*a'* to correspond to the taper of the iron. The two tapered edges 16*a'* meet at an uppermost point to form an apex 16*a''*.

The housing 16 also has a pair of side walls 16*b* each of which has a narrow side portion extending along a respective tapered edge 16*a'* and a lower wide side wall portion 16*b''*. The narrow side wall portion 16*b'* has an edge 16*c* and the wide side wall portion has an edge 16*d*. Thus, each side wall 16*b* has a side wall portion 16*b'* which extends along the entire length of a respective edge 16*a'* of the rear wall 16*a* to the apex 16*a''*, and a side wall portion 16*b''* which extends only partially towards the apex.

A front wall 16*e* of the housing extends to the same height as the side wall portion 16*b''* and has an edge 16*f*, the edges 16*c*, 16*d* and 16*f* blending at the juncture points to form a smooth and continuous edge as shown. The last described continuous edge formed by the upper edges 16*d* and 16*f* of the frontwardly disposed wall portions 16*b''* and the front wall respectively and the front edge 16*c* of the rearwardly disposed wall portions 16*b'* defines an opening 16*g* through which the iron 12 may pass, as to be described.

The opening 16*g* may further be defined as including a passageway or space 16*h* in the front wall 16*e* which is dimensioned to correspond to the transverse dimensions of the handle 12*c*. In this manner, the body 12*a* of the iron 12 may be placed into and removed from the housing 16 through the opening 16*g* by gripping the handle 12*c* and moving the same through the passageway 16*h*. The shape and size of the opening 16*g* suggested in the FIGURE permits an iron to pass through the opening by somewhat increasing the angle of incline of the heated plate 12*b* and lowering the iron gradually, while in the position substantially as shown, through the opening 16*g*. When fully received within the housing 16, the apex of the iron is moved forwardly to position the heated plate within the confines of the narrow side wall portions 16*b'* at its normal resting angle of inclination.

Figure 2:
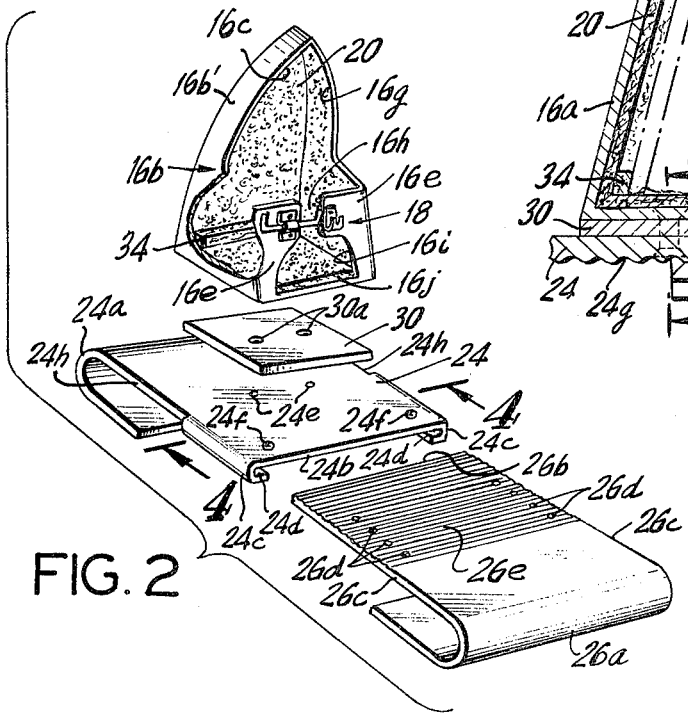
FIG. 2 is an exploded perspective view of the safety stand shown in FIG. 1, showing the arrangement of parts prior to assembly.

The housing 16 further has a bottom wall 16*j*. The passageway 16*h* is advantageously enlarged at the lower region thereof to form an opening 16*i* through which an electric cord of the iron 12 can pass when the iron is positioned within the housing. As best depicted in FIG. 2, the housing is fully closed by the above described wall with the exception of the openings 16*g*, 16*h* and 16*i*.

A further feature of the invention is the provision of locking means in the form of a latch 18 mounted on the front wall 16*e* for selectively bridging the passageway 16*h* and for engaging the handle 12*c* when the iron is within the housing 16 to thereby prevent the iron from moving out of the housing during periods of non-use of the iron. In this manner, the heated portions of the iron are maintained concealed in all positions and orientations which the housing may assume.

Figure 6:
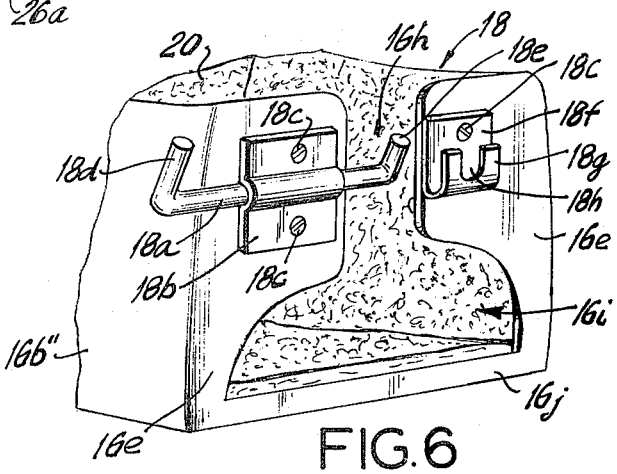
FIG. 6 is a enlarged fragmented section of the front portion of the housing forming part of the stand shown in FIGS. 1 and 2, showing the details of the latch which prevents inadvertent movement of the iron from the covered positions suggested in FIGS. 1 and 3 out of the housing.

The specific type of latch or lock 18 which is used is not critical for the purposes of the present invention. Many known locks and latching mechanisms may be used, with different degrees of advantages. The lock must be capable of being maintained securely latched in all positions and orientations of the housing 16. For the lock to be consistently used, it must not be cumbersome or inconvenient to use. Shown in FIG. 6, only by way of example, a latch 18 which exhibits the above requirements.

The latch 18 includes a bolt or pin 18*a* slidably mounted on the front wall 16*e* by means of a flange or bracket 18*b*. The flange 18*b* may be connected to the front wall 16*e* by means of screws or rivets 18*c*. The bolt includes a gripping extension 18*d* at one end thereof and a latching extension at the other end thereof, the latching extension 18*e* being positionable on each side of the passageway 16*h* to bridge or clear the latter. A keeper 18*f* of the latch 18 is mounted on the front wall 16*e* as shown, by means of screws or rivets 18*c*. The keeper 18*f* includes a frontwardly disposed tab 18*g*, the latter being provided with a recess or cut-out portion 18*h* dimensioned to receive the latching extension 18*e*.

To lock the iron 12, the latter is placed within the housing 16 as shown in FIGS. 1 and 3. With the extensions 18*d* and 18*e* turned upwardly into a vertical plane, the bolt, 18*a* may be slidably moved to clear the passageway 16*h*. The iron may now be placed within the housing without interference from the latch 18. In the resting position of the iron, the bolt 18*a* is aligned with the opening formed by the handle 12*c* and the iron body 12*a*. The bolt 18*a* is now moved, with the extensions directed upwardly in a vertical plane, to bridge the passageway 16*h* and move the latching extension 18*e* in alignment with the recess 18*h*. Locking may now be effected by turning the extensions approximately 90° about the axis of the bolt 18*a* into a horizontal plane. The locked condition of the latch 18 will be maintained irrespective of the position of the housing 16 to prevent the iron from moving out of the latter.

The interior surface of the housing is lined with an insulating material 20. The insulation, which may be of any commercially available type, is provided to minimize heat transfer from the heated portions of the iron and the housing 16 so that the latter does not become excessively heated and remains at a sufficiently low temperature to prevent injury upon contact.

Mounting means, designated by the reference numeral 22 in FIG. 1, is provided to easily and securely mount the housing 16 on the ironing board 14. The mounting means 22 includes a pair of bases 24 and 26.

The base 24 has a hook-shaped free end to form a gripping portion 24*a* and a planar free end 24*b*. The hook-shaped end 24*a* is dimensioned to engage one of the opposing egdes of the ironing board 14.

The base 24 is provided with guide portions 24*c* each defining a guide channel 24*d* for guiding the base 26, as to be described. Each of the guide portions is in the form of an extension having a generally U-shaped transverse cross-section and extending from another of the opposing edges 24*h* of the base 24.

Figure 4:
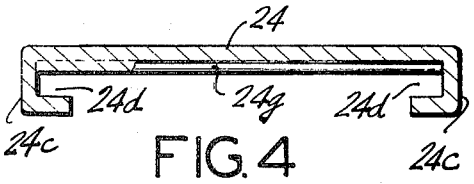
FIG. 4 is an enlarged cross-section of the safety stand shown in FIG. 2, taken along line 4—4.

Two centrally spaced apertures 24*e* are provided for mounting the housing 16 on the base 24, and two apertures 24*f* are provided at the planar free end 24*b* for adjustably securing the bases 24 and 26 to each other, as to be described, to fix the safety stand 10 to the ironing board 14. As shown in FIGS. 3 and 4, internal ribs or protuberances extend transversely between the guide channels 24*d*, the ribs being provided to prevent relative movement between the bases 24,26 once secured to each other.

The base 26 is similar in shape to the base 24 and has a gripping portion 26*a* and a planar portion 26*b*. A series of spaced threaded holes 26*d* extend along the opposing edges 26*d*, the holes 26*d* being arranged in pairs to be selectively alignable with the holes or apertures 24*f* in the base 24.

Transverse ribs 26*e* are provided on the upper surface of the base 26, the ribs 24*g* and 26*e* being engageable and forming complementary surfaces in the nature of friction producing means for preventing sliding movement between the bases 24,26 when the ribs 24*g*,26*e* are engaged and the bases are connected to each other with screw 28. As shown, the planar free ends 24*b*, 26*b* are connectable to each other in any one of a plurality of overlapping conditions by alignment of the pair of apertures 24*f* with one of the pairs of holes 26*d*. The provision of transverse ribs, as described, or other friction producing means on the facing or opposing surfaces of the overlapping planar portions prevents inadvertent longitudinal movement of the bases relative to each other and separation of the bases from the ironing board when the bases are moved to and locked in positions which results in secure abutting engagement between the gripping portions 24*a*,26*a* and the ironing board 14.

A mounting plate 30 is provided which serves both as a spacer between the bottom wall 16*j* of the housing 16 and the base 24, and to increase the aesthetic appearance of the unit.

Figure 5:
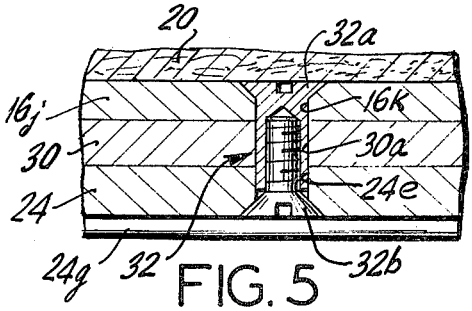
FIG. 5 is an enlarged cross-section of the safety stand shown in FIG. 3, taken along line 5—5.

The manner of assembling the unit 10 will now be described, particularly with reference to FIGS. 2 and 5. The housing 16, the mounting plate 30 and the base 24 are all connected together with two fasteners 32, which respectively extend through a set of aligned apertures in the three connected members, namely aperture 16*k* in the bottom wall 16*j*, aperture 30*a* in the mounting plate 30, and aperture 24*e* in the base 24. The specific type of fastener 32 used is not critical. However, the fastener shown in FIG. 5 is particularly suitable and permits easy and rapid assembly. The fastener 32 includes a flathead screw 32*a*, in the nature of a rivet, which has an internally threaded bore in its shank. The fastener further includes a flathead screw 32*b* which has an external thread to be threadedly engage the internal thread of the screw 32*a*. Countersinks provided in the upper surface of the bottom wall 16*j* and in the lower surface of the base 24 avoids any protuberances or projections from these surfaces which may interfere with with the movements with the iron 12 within the housing 16 or prevent free movement of the bases relative to each other. The layer of insulation 20 is disposed on the bottom wall 16*j* to cover the screw head 32*a*.

Once the housing 16 is mounted on the base 24, the unit 10 may be mounted on the ironing board 14 by aligning the bases 24 and 26 as shown in FIG. 2 and inserting the planar end 26*b* between the guide portions 24*c* for slidable movement within the guide channels 24*d* to cause at least some overlap between the planar free ends 24*b* and 26*b*. The buses 24 and 26 are now moved relative to each other along the longitudinal directions thereof to a selected degree of overlap of the planar free ends. The guide portions 24*c* maintain the bases aligned to permit the gripping portions 24*a* and 26*a* to receive the opposing parallel edges of the ironing board. The bases 24 and 26 are advanced towards each other until the gripping portions forcefully engage the edges of the ironing board. A sufficient number of sets of threaded holes 26*d* are provided to permit alignment of the holes 24*f* and a pair of holes 26*d* in a condition of such forceful engagement. When the screws 28 are tightened, the ribs 24*g*, and 26*e* engage and prevent separation of the bases and securely maintain the unit 10 on the ironing board. To provide a greater degree of adjustability of the bases relative to each other, the pairs of holes 26*d* may be replaced by a pair of longitudinal slots extending parallel to the edges 26*c*.

In the presently preferred embodiment, a resilient spacer strip 34 made of a heat resistive material is provided which extends along the corner formed by the rear wall 16*a* and the bottom wall 16*j*, as shown in FIGS. 2 and 3. Insertion of the iron 12 into the housing 16 at least partially compresses the strip 34 which serves both to space the heated plate 12*b* from the rear wall 16*a* and to prevent excessive movements of the iron within the housing.

What has been described above is a safety stand which is simple in construction and economical to manufacture, and which conceals the heated portions of the iron during periods of non-use. The housing 16 substantially encloses and covers the heated iron portions by closely conforming to the dimensions of the iron. However, the housing is made slightly larger to permit easy insertion into and removal of the iron from the housing. For example, a distance 36 of approximately ¼ inch is sufficient to permit movement of the iron into and out of the housing 16 while maintaining the heated portions of the iron covered or concealed.

In contrast with most prior art iron stands, the present stand 10, by reason of the configuration of the housing 16 and the manner in which the latter is mounted, maintains the iron in its normal resting position during periods of non-use. The above described configuration of the housing 16, including the opening 16*g* which opens in the upward direction, permits heat generated by the iron to escape through the opening 16*g* without heating up the walls of the housing. The handle 12*c* of the iron, which is disposed through a frontal portion of the housing, is similarly prevented from overheating by the rising heat.

One of the present features of the present invention is that the stand 10 continues to provide protection when the ironing board 14 is knocked down, such as by a child, and the housing assumes a position and orientation different from that shown in the FIGS. This is due to the configuration of the housing 16, the limited movement of the iron within the housing and the latch 18 which prevents the iron from moving out of the housing when the same is locked. This improved degree of safety is achieved without sacrificing facility of use and simple and economical construction. Numerous alterations of the structure herein disclosed will suggest themselves to those skilled in the art. However, it is to be understood that the present disclosure relates to a preferred embodiment of the invention which is for illustration only and is not to be construed as a limitation of the invention.

What is claimed is:

1. A safety stand for an iron, wherein the iron has heated portions and a handle, comprising a substantially closed housing for receiving the iron and covering the heated portions thereof, said housing having an opening therein said housing having an inclined rear wall having tapering edges to form an apex at the top thereof, a pair of sidewalls, each side wall having a rearwardly disposed wall portion which extends along the entire length of the edges of said rear wall to said apex, and a frontwardly disposed wall portion which extends only partially towards said apex, a front wall which extends upwardly to the same extent as said frontwardly disposed wall portions, the major portion of said opening being formed by the upper edges of said front wall and said frontwardly disposed wall portions and the front edges of said rearwardly disposed wall portions, said opening being dimensioned to permit insertion into and removal of the iron from said housing, said opening further comprising a passageway in said front wall dimensioned to correspond to the transverse dimensions of the handle, whereby the body of the iron may be found through said major portion of said opening and the handle may be moved through said passageway to position the iron within said housing in a normal resting position during periods of iron non-use, said housing being configurated to at least partially expose the handle of the iron through said opening when the iron is disposed within said housing to permit gripping of the handle for movement of the iron into and out of said housing; mounting means for securely fixing said housing to a support surface; and locking means provided on said front wall for engaging the handle when the iron is disposed within said housing and preventing the iron from moving out of said housing during periods of non-use of the iron, said locking means comprising a latch having a bolt mounted for axial movement on said front wall to one side of said passageway, and keeper means fixedly mounted on said front wall to the other side of said passageway, said bolt being movable to an engaging condition with said keeper means between the handle and the body of the iron, whereby said bolt retains the iron within said housing in the keeper means engaging condition, whereby the heated portions of the iron are maintained concealed in all positions and orientations which said housing may assume; and whereby the iron is safely maintained on a desired support surface and has the heated portions thereof during periods of non-use.

2. A stand as defined in claim 1, wherein said housing is configurated to conform to the exterior shape of the iron and dimensioned to receive the latter with little clearance therebetween, whereby the iron is prevented from excessive movements within said housing.

3. A stand as defined in claim 1, further comprising spacer means within said housing made of a resilient material to resiliently abut against an iron received within said housing, said spacer means spacing the heated portions of the iron from the walls of said housing and preventing excessive movements of the iron therein.

4. A stand as defined in claim 1, in combination with an ironing board, wherein said mounting means secures said housing to a portion of said ironing board, said locking means preventing movement of the iron out of said housing to thereby maintain the heated portions of the iron concealed subsequent to inadvertent turning over of said ironing board from its normal upright position.

5. A stand as defined in claim 1, further comprising insulation means provided on the interior surfaces of said housing which are coextensive with the heated portions of the iron, whereby the exterior surface of said housing does not become overheated when the iron is positioned within said housing for extended periods of time.

6. A stand as defined in claim 1, wherein said opening is in the region of the top of said housing and the handle of the iron is disposed through a frontal portion of said opening, whereby the heat generated by the heated portions of the iron may escape through the top of said housing without heating the handle of the iron.

7. A safety stand for an iron, wherein the iron has heated portions and a handle, comprising substantially closed housing for receiving the iron and covering the heated portions thereof, said housing having an opening therein dimensioned to permit insertion into and removal of the iron from said housing, said housing having a bottom wall and being configurated to at least partially expose the handle of the iron through said opening when the iron is disposed within said housing to permit gripping of the handle for movement of the iron into and out of said housing; and mounting means for securely fixing said housing to a support surface, said mounting means being connected to said bottom wall and said mounting means being adapted to be secured to an end of an ironing board, said mounting means comprising a pair of bases each having a planar free end and a hook-shaped free end, said hook-shaped free ends each being dimensioned to engage another opposing edge of the ironing board end, said planar free ends being connectable to each other in any one of a plurality of overlapping conditions, whereby said planar free ends may be connected to each other to dispose said hook-shaped free ends in forceful engagement with the opposing edges of the ironing board, and said mounting means and said housing become securely fixed to the ironing board, said hook-shaped free ends extending transversely to the longitudinal direction of said bases and being parallel to each other, and wherein said bases are movable relative to each other along said longitudinal direction prior to connection to selectively regulate the extent of overlap of said planar free ends, and further comprising guide means for maintaining said hook-shaped free ends parallel to each other in all longitudinal positions of said bases relative to each other, said planar free ends being disposed coextensively to each other in the overlapping conditions thereof and having the longitudinal opposing edges thereof substantially in alignment, said guide means comprising extensions on the two opposing edges of said planar free ends of one of said bases, each of said extensions having a generally U-shaped transverse cross-section to form a guide channel for receiving a respective edge of the other of said bases, whereby said guide channels maintain said bases aligned in said longitudinal direction; whereby the iron is safely maintained on a desired support surface and has the heated portions thereof concealed during periods of non-use.

8. A stand as defined in claim 7, wherein said planar free ends of said bases are provided with friction producing means for preventing movement of said bases relative to each other to separate said hook-shaped free ends when said planar free ends are connected to each other, whereby said friction producing means prevents inadvertent separation of said mounting means from the ironing board.

9. A stand as defined in claim 8, wherein said hook-shaped free ends extend transversely to the longitudinal direction of said bases and are parallel to each other, and wherein said friction producing means comprises transverse protuberances on the overlapping and engaging surfaces of said planar free ends, whereby connection of said planar free ends in overlapping relation causes the respective transverse protuberances to engage and lock said bases against longitudinal movements.

10. A stand as defined in claim 9, wherein said protuberances are in the form of complementary transverse ribs on the opposing engaging surfaces of said planar free ends.

11. A stand as defined in claim 7, wherein said housing is configurated to conform to the exterior shape of the iron and dimensioned to receive the latter with little clearance therebetween, whereby the iron is prevented from excessive movements within said housing.

12. A stand as defined in claim 7, further comprising spacer means within said housing made of a resilient material to resiliently abut against an iron received within said housing, said spacer means spacing the heated portions of the iron from the walls of said housing and preventing excessive movements of the iron therein.

13. A stand as defined in claim 7, further comprising insulation means provided on the interior surfaces of said housing which are coextensive with the heated portions of the iron, whereby the exterior surface of said housing does not become overheated when the iron is positioned within said housing for extended periods of time.

14. A stand as defined in claim 7, wherein said opening is in the region of the top of said housing and the handle of the iron is disposed through a frontal portion of said opening, whereby the heat generated by the heated portions of the iron may escape through the top of said housing without heating the handle of the iron.

15. A stand as defined in claim 7, further comprising locking means provided on said front wall for engaging the handle when the iron is disposed within said housing and preventing the iron from moving out of said housing during periods of non-use of the iron, whereby the heated portions of the iron are maintained concealed in all positions and orientations which said housing may assume.

16. A stand as defined in claim 15, in combination with an ironing board, wherein said mounting means secures said housing to a portion of said ironing board, said locking means preventing movement of the iron out of said housing to thereby maintain the heated portions of the iron concealed subsequent to inadvertent turning over of said ironing board from its normal upright position.

17. A stand as defined in claim 15, wherein said locking means comprises a latch having a bolt mounted for axial movement on said front wall to one side of said passageway, and keeper means fixedly mounted on said front wall to the other side of said passageway, said bolt being movable to an engaging condition with said keeper means between the handle and the body of the iron, whereby said bolt retains the iron within said housing in the keeper means engaging condition.

* * * * *